US005269715A

United States Patent [19]

Silveria et al.

[11] Patent Number: 5,269,715

[45] Date of Patent: Dec. 14, 1993

[54] SOAP BUBBLE MAKING APPARATUS

[76] Inventors: Richard W. Silveria, 514 Groton St., Dunstable, Mass. 01827; Richard R. LeBourdais, 154 Wellman Ave., N. Chelmsford, Mass. 01863

[21] Appl. No.: 936,583

[22] Filed: Aug. 27, 1992

[51] Int. Cl.[5] ..... A63H 33/28; A63H 33/40

[52] U.S. Cl. ..... 446/16; 446/18; 446/21; 446/217

[58] Field of Search ..... 446/15, 16, 17, 18, 446/21

[56] References Cited

U.S. PATENT DOCUMENTS

| | | | |
|---|---|---|---|
| 2,547,825 | 4/1951 | King | 446/16 |
| 2,736,988 | 3/1956 | Fisher | 446/17 |
| 2,794,292 | 6/1957 | Noble | 446/16 |
| 2,987,847 | 6/1961 | Jones | 446/17 |
| 4,044,496 | 8/1977 | Jernstrom | 446/16 |
| 4,184,284 | 1/1980 | Royahn | 446/15 |
| 4,576,582 | 3/1986 | Panzarella | 446/16 |
| 5,102,381 | 4/1992 | Danielak et al. | 446/15 |

*Primary Examiner*—Robert A. Hafer
*Assistant Examiner*—Gregory M. Stone
*Attorney, Agent, or Firm*—William B. Ritchie

[57] ABSTRACT

A bubble bath bubble toy. This toy with a rotatable hub for altering bubble size is designed to produce bubbles in clear, soapy or bubble bath water. For years children have been fascinated by the production of bubbles. This apparatus allows children to safely and easily produce bubbles on their own. With this apparatus, the user turns a crank which activates several gears turning a bubble wheel with aeration vanes. The motivation of these aeration vanes produces a mixing of air, water and bubble mixture sufficient to produce bubbles. This toy allows for the production of bubbles from previously utilized water containing some amounts of bubble fluid. This helps to limit the cost of bubble production.

6 Claims, 3 Drawing Sheets

SOAP BUBBLE MAKING APPARATUS

BACKGROUND OF THE INVENTION

1. Field of the Invention

The invention relates to devices for making soap bubbles.

2. Description of the Related Art

Children are fascinated with the production of soap bubbles. For this reason, numerous types of bubble toy machines have been developed. Perhaps the oldest and simplest is the wire or plastic frame which is dipped into bubble making liquid, such as liquid dish washing soap, and bubbles are then blown from the wire. In recent years, more elaborate toys have been developed using the same basic theory. These toys are designed for the user to blow on part of the apparatus to produce bubbles. The disadvantage with this technique is that the user must place their mouth on or about the apparatus. This is a problem, particularly when there are many users operating the apparatus, thus promoting the spread of germs among children. There have been toys developed over the years which do not necessitate the user operating the apparatus by blowing on it. However, most of these devices are complex and therefore expensive to produce. Most of these devices produce bubbles by blowing air through bubble solution.

Representative of the genre is U.S. Pat. No. 4,347,682. The patent is a bubble toy operated by manually blowing through an opening in the center of the toy. The air is blown through a cap on the end of the toy. This cap is emerged in the bubble solution, and as the air enters the cap, soap bubbles are formed.

Another bubble toy is represented by U.S. Pat. No. 4,044,496. This toy is activated by rotating a gear crank, which turns a propeller. This toy is not designed to submerge into water and bubble solution, but rather the solution is introduced into a resevoir within the toy itself.

Another bubble toy is represented by U.S. Pat. No. 3,708,909. This toy utilizes a disk with apertures. However, this toy is operated by pneumatic force rather than manual operation.

The prior art does not show a safe bubble producing toy that can be used successfully by a child in a bathtub or other clear or soapy water area, that is unique in the manner of bubble production, and that is capable of reusing the bubble solution. In addition, the prior art does not show a bubble producing toy that utilizes water, air and bubble solution as opposed to only air and bubble solution.

SUMMARY OF THE INVENTION

It is an object of the invention to provide a bubble making toy that is easy to operate.

It is another object of the invention to provide a bubble making toy that is safe to operate.

It is still another object of the invention to provide a bubble making toy to be utilized in a water environment.

It is still another object of the invention to provide a bubble making toy that improves bubble production.

It is still another object of the invention to provide a bubble making toy that controls and limits undesired splashing during its operation.

It is still another object of the invention to provide a bubble making toy that provides an easily adjustable method of changing the bubble size, density and bubble quantity.

It is still another object of the invention to provide a bubble making toy that is relatively inexpensive to produce.

It is still another object of the invention to provide a bubble making toy that is aesthetically pleasing.

It is still another object of the invention to provide a bubble making toy that uses new and recycled bubble fluid.

The invention is a bubble producing toy. A bubble wheel, having a top surface, mounted in a rotatable manner is provided. A plurality of aeration vanes substantially perpendicular to the top surface of said bubble wheel are provided. An inner hub, having a vertical wall with a plurality of openings, is provided. An outer hub, having a vertical wall and a dome wall, with said walls having a plurality of openings, with said outer hub, rotatable relative to said inner hub is provided wherein the openings on the vertical wall of said inner hub can be aligned with openings on the vertical wall of said outer hub. Means for rotating the bubble wheel are provided, wherein said bubble wheel is introduced to bubble producing solution, and wherein rotation of said bubble wheel causes an aeration and mixture of air, water and bubble solution, thus producing bubbles.

DETAILED DESCRIPTION OF THE INVENTION

Figure 1:
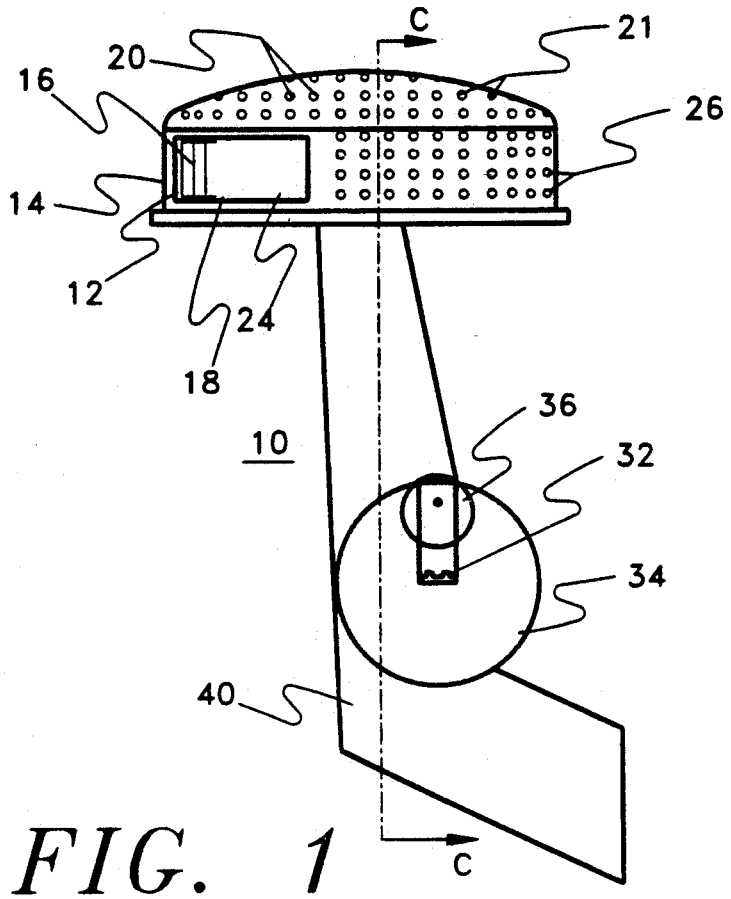
FIG. 1 is a side view of the soap bubble making apparatus in accordance with the invention.

FIG. 1 is a side view of the soap bubble making invention 10. This toy is designed to be used in clear water, soapy water or bubble bath water. Note all parts are preferably fabricated from non-toxic plastic to ensure the safety of the user.

There are two principal modes of operation. The first utilizes only the force of a stream of water entering passive opening 24. Passive opening 24 of inner hub 12 is aligned with passive opening 24 of outer hub 14. Invention 10 is held by handle housing 40 and placed under flowing water from a water faucet. The force of the water against the vanes 16 causes bubble wheel 18 to rotate, with vanes 16 effecting an aeration and mixture of air, water and bubble solution which creates bubbles which are created by and escape through bubble openings 20,21,26 and 27 (shown in FIG. 5) and passive openings 24. In the passive mode of operation, the crank handle 36 is in a closed position. When the crank handle 36 on the handle housing 40 is closed, by pivoting at hinge 37, shaft 54 retracts and disengages the gears, allowing the bubble wheel 18 to freely rotate. When the crank handle 36 is in an open, rather than closed position, the gears are engaged, and the bubble wheel 18 will not rotate freely.

Figure 2:
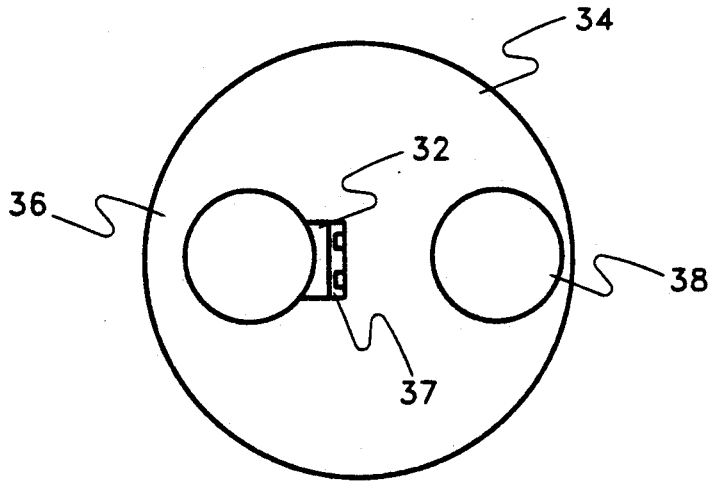
FIG. 2 is a side view of the hand crank assembly shown in the open position.

In the active mode of operation, the user places invention 10 into the water and turns the crank handle 36 (shown in its opened position with gears engaged in FIG. 2) which is connected to crank arm 32 to effect motion of bubble wheel 18 via a shaft and gear assembly which is discussed below. When invention 10 is placed into the water, water enters the inner and outer hub assembly via the plurality of openings on the inner and outer hubs. Note that crank handle 36 is stored in opening 38 in crank base 34 when invention 10 is used in the passive mode. When in the stored position, the gears are disengaged, thereby permitting free-wheeling of bubble wheel 18.

While the preferred drive mechanism utilizes a simple crank assembly in combination with a shaft and gear assembly, other modes of operation could include powering the bubble wheel 18 by such devices as a spring, electrical motor, or a pull driven method. All of the above modes of operation would result in the production of bubbles and the recycling of bubble solution, since the toy immerses in the water containing previously used bubble solution. Thus, the same solution is continually reused. This is a distinct advantage in restricting the cost of operation of the toy.

Figure 3:
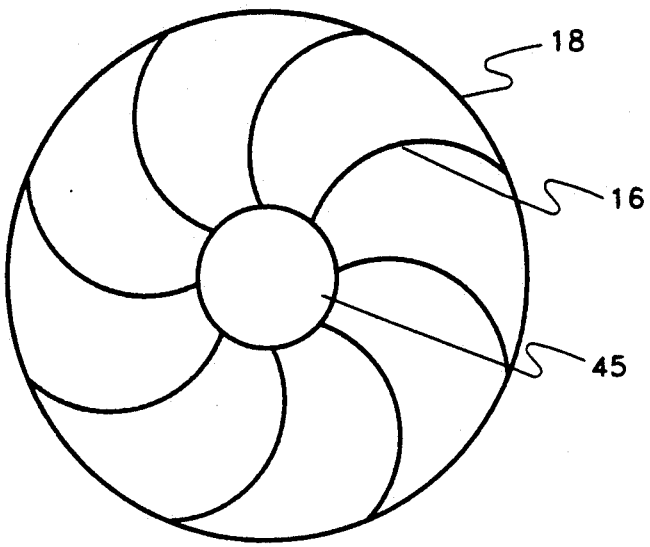
FIG. 3 is a front view of the bubble wheel with aeration vanes and reservoir screw base.

FIG. 3 is a front view of the bubble wheel assembly. The assembly is preferably 4¾ inches in diameter. Attached substantially perpendicularly to rotatable bubble wheel 18 is a plurality of curved aeration vanes 16, preferably 1½ inches high. When bubble wheel 18 is rotated, the aeration vanes 16 subsequently move at the same rate as the bubble wheel 18, causing a mixing of the water, bubble solution and air. This results in the production of bubbles. The aeration vanes 16 are integral with bubble wheel 18. In the center of bubble wheel 18 is a screw base 45, which accommodates reservoir screw base. Bubble wheel screw base 45 has female threads, while the reservoir screw base 60 has male threads. The thread types of the screw bases can be reversed. The reservoir screw base 60 will attach securely to the bubble wheel screw base 45.

Figure 4:
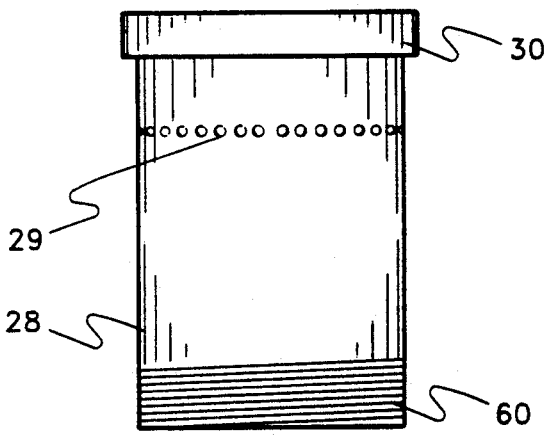
FIG. 4 is a side view of the bubble making fluid reservoir.

FIG. 4 is a side view of the bubble making fluid reservoir 28, which is preferably 1½ inches high and 1¼ inches in diameter.

Reservoir 28 is held in place on bubble wheel 18 by reservoir screw base 60, secured to bubble wheel screw base 45. Reservoir 28 is filled with bubble fluid, such as bubble bath liquid and secured with cap 30. Preferably cap 30 is attached with threads so that it is firmly held in place, however, a snap cap or other similar arrangements would also be acceptable. The user simply unscrews cap 30 and fills reservoir 28 with bubble making fluid. Bubble making fluid is distributed to vanes 16 as a result of centrifugal force when bubble wheel 18 is rotated via openings 29. The contents of the reservoir 28 would be fully consumed during each use of the toy. Additional bubble solution can be introduced as needed via the reservoir 28. An optional reservoir in conjunction with a pump system could be located within the handle.

Figure 5:
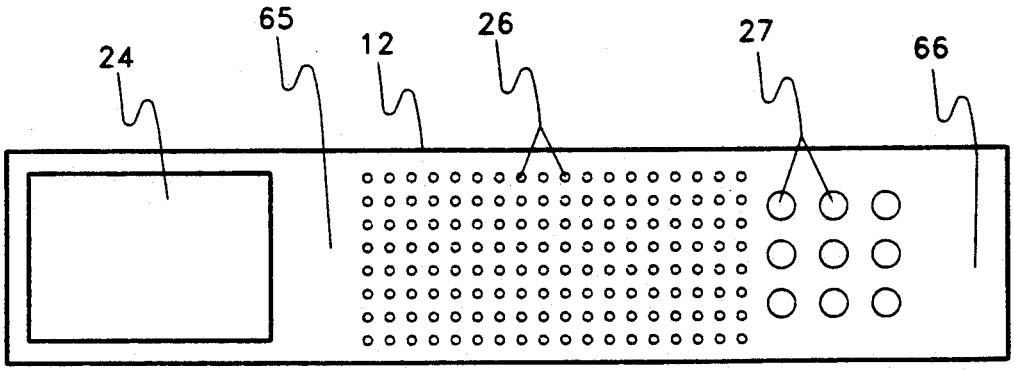
FIG. 5 is a planar side view of the inner hub of the invention.

FIG. 5 is a planar side view of the inner hub 12. Inner hub 12 is preferably a molded cylindrical shape of plastic 5 inches in diameter, with walls 2½ inches high. Passive opening 24 is preferably 2½ inches long and 1½ inches wide. Adjacent to passive opening 24 are preferably 3 inch length areas of closed space 65 and 66. Bubble making openings 26 preferably cover an area 4 and ⅝ inches in length, and are arranged in 18 rows, of ⅛ inches in diameter separated by ⅛ inch closed space. Bubble making openings 26 begin 5/16 inch from each edge of inner hub 12 and are eight columns wide. Columns are separated by ⅛ inch closed space. In addition, large bubble making openings 27 preferably cover an area of 2 and ¾ inches of length and are arranged in 3 rows of openings ½ inches in diameter separated by two ⅝ inch closed spaces. Large bubble making openings 27 are three columns wide and begin ¼ inch from each edge. Columns are separated by a ¼ inch closed space. Inner hub 12 is preferably integral with housing 40, but may be fastened to housing 40 by screws and/or glue.

Figure 6:
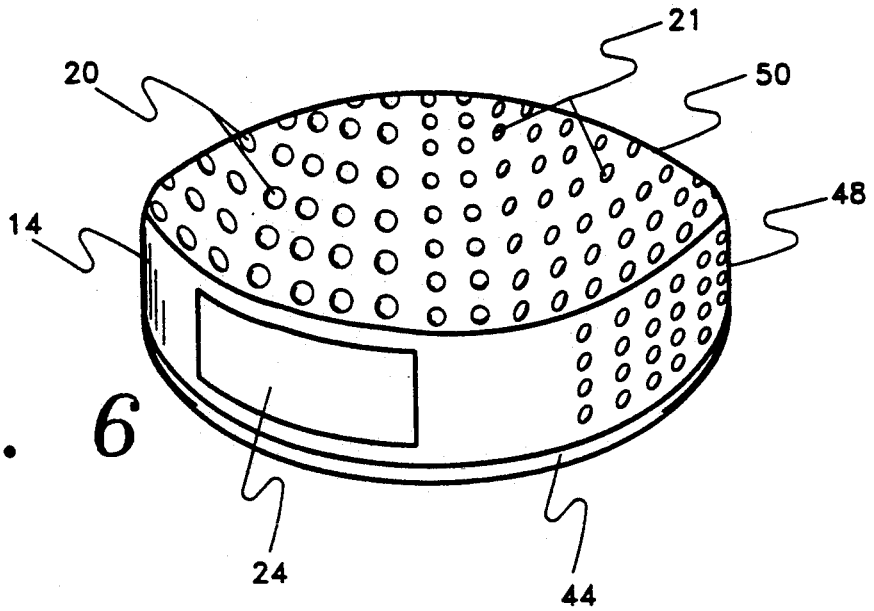
FIG. 6 is an isometric view of the outer hub of the invention.

FIG. 6 is an isometric view of outer hub 14. Outer hub 14 is also preferably molded in a single piece of plastic of slightly larger diameter to that of inner hub 12. Edge 44 of outer hub 14 is snapped into track 46 (shown in FIG. 7) so that it can be easily removed or rotated relative to inner hub 12. The sizes and placement of openings on the vertical surface 48 of outer hub 14 correspond to the sizes and placement of openings on inner hub 12. Thus, when outer hub 14 is rotated around inner hub 12, it is possible to change the sizes and total area of bubble making orifices. Further, as outer hub 14 is easily removable, the majority of the water and bubbles would pass through open top of inner hub 12 creating a different effect.

The dome wall 50 of the outer hub 14 provides a plurality of openings. The half of the dome wall 50 adjacent to the passive opening 24 has a plurality of ½ inch openings 20 positioned in a uniform pattern, while the remaining half of the dome wall 50 has a plurality of ⅛ inch openings 21 positioned in a uniform pattern.

Figure 7:
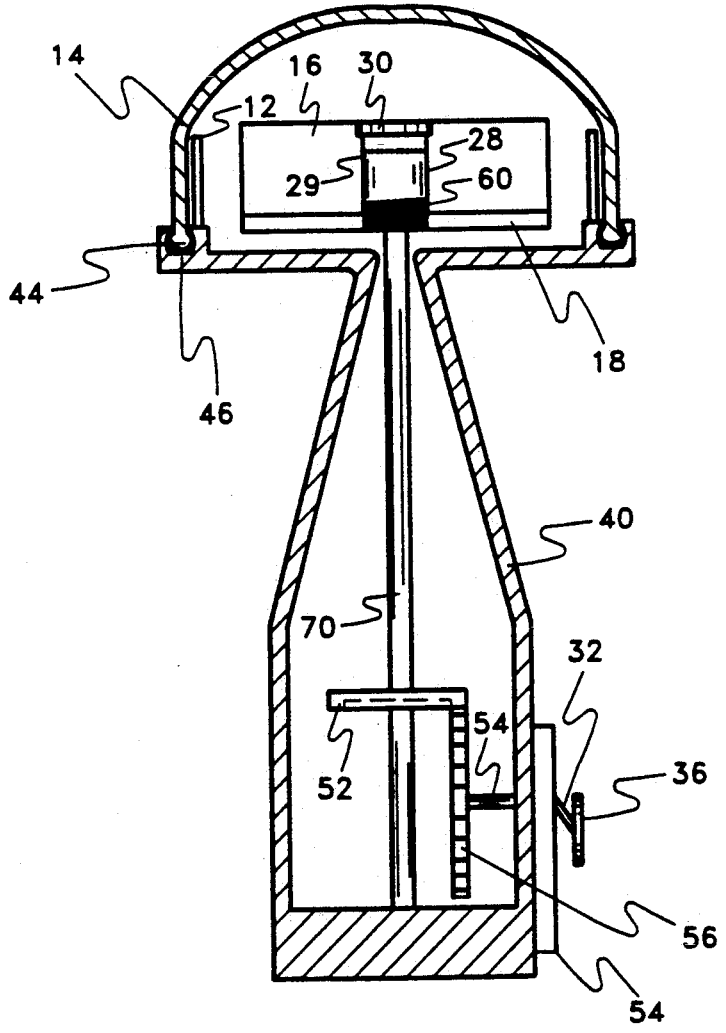
FIG. 7 is a cross-sectional view of the apparatus along line c—c shown in FIG. 1.

FIG. 7 is a cross-sectional view of the apparatus along line c—c shown in FIG. 1. This view shows one possible gear and crank shaft drive assembly arrangement. Other types and combination of gear such as helical or planetary could also be used. When handle 36 is turned, crank shaft 54 causes gear 56 to rotate. Gear 56 engages a smaller gear 52 thus increasing the number of rotations of bubble wheel 18, via drive shaft 70, for each turn of handle 36. A gear ratio of 4:1 or greater is preferred. When handle 36 is in open position as shown, gear 56 engages gear 52. As discussed above, when handle 36 is in a closed position, gear 56 moves away from gear 52, thus allowing bubble wheel 18 to substantially rotate freely. To improve the engaging-disengaging action, a option spring (not shown) could be attached around shaft 54.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A soap bubble making apparatus comprising:

a housing having a drive shaft within said housing;

a bubble wheel, having a top surface, mounted in a rotatable manner to said drive shaft;

a plurality of aeration vanes substantially perpendicular to the top surface of said bubble wheel and attached to said top surface of said bubble wheel;

an inner hub, having a vertical wall with a plurality of openings, said inner hub secured to said housing;

an outer hub, having a vertical wall and a dome wall, with said vertical wall and said dome wall having a plurality of openings, and said outer hub rotatable relative to said inner hub, wherein the openings on the vertical wall of said inner hub can be aligned with openings on the vertical wall of said outer hub, said outer hub rotatably attached to said housing with said inner hub located within said outer hub;

means for rotating said bubble wheel, wherein said bubble wheel is introduced to bubble producing solution, and wherein rotation of said bubble wheel causes an aeration and mixture of air, water and bubble solution, thus producing bubbles.

2. The apparatus of claim 1 wherein inner hub further comprises a substantially rectangular opening in its vertical wall and wherein said outer hub further comprises a substantially rectangular opening in its wall with the two said rectangular openings having substantially the same dimensions.

3. The apparatus of claim 2 wherein said outer hub is rotated about said inner hub such that said rectangular openings of the inner and outer hubs are in alignment so that a stream of water may be introduced through said aligned rectangular openings thus causing said vanes attached to said bubble wheel to rotate thus producing bubbles.

4. The apparatus of claim 3 wherein said outer hub is removable.

5. The apparatus of claim 4 wherein said means for rotating further comprises a crank shaft connected to said drive shaft via a plurality of gears, a crank arm with a handle connected to said crank shaft such that when said handle is rotated once about said crank shaft, said bubble wheel is rotated more than once about said drive shaft.

6. The apparatus of claim 5 further comprising a reservoir for holding bubble making fluid centered in said bubble wheel, said reservoir having a plurality of openings through which said bubble making fluid is distributed to said vanes.

* * * * *